US005388645A

United States Patent [19]

Puri et al.

[11] Patent Number: 5,388,645

[45] Date of Patent: Feb. 14, 1995

[54] METHOD FOR PRODUCING METHANE-CONTAINING GASEOUS MIXTURES

[75] Inventors: Rajen Puri, Aurora, Colo.; Paul T. Pendergraft, Tulsa, Okla.

[73] Assignee: Amoco Corporation, Chicago, Ill.

[21] Appl. No.: 146,920

[22] Filed: Nov. 3, 1993

[51] Int. Cl.[6] ..... E21B 43/18; E21B 43/26

[52] U.S. Cl. ..... 166/268; 166/271

[58] Field of Search ..... 166/266, 267, 268, 271, 166/305.1; 95/138, 47, 54

[56] References Cited

U.S. PATENT DOCUMENTS

| | | | |
|---|---|---|---|
| 3,845,196 | 10/1974 | Rhoades | 166/267 |
| 4,043,395 | 8/1977 | Every et al. | 166/263 |
| 4,169,506 | 10/1979 | Berry | 166/267 X |
| 4,344,486 | 8/1982 | Parrish | 166/266 X |
| 4,353,148 | 10/1982 | Hoekstra et al. | 166/267 X |
| 4,400,034 | 8/1983 | Chew | 299/5 |
| 4,446,921 | 5/1984 | Coenen et al. | 166/267 |
| 4,544,037 | 10/1985 | Terry | 166/369 |
| 4,756,367 | 7/1988 | Puri et al. | 166/263 |
| 4,883,122 | 11/1989 | Puri et al. | 166/263 |
| 5,014,785 | 5/1991 | Puri et al. | 166/263 |
| 5,014,788 | 5/1991 | Puri et al. | 166/308 |
| 5,053,578 | 10/1991 | Michaels et al. | 585/500 |
| 5,085,274 | 2/1992 | Puri et al. | 166/252 |
| 5,099,921 | 3/1992 | Puri et al. | 166/266 |
| 5,133,406 | 7/1992 | Puri | 166/266 |
| 5,147,111 | 9/1992 | Montgomery | 299/16 |

FOREIGN PATENT DOCUMENTS 609917 6/1978 Russian Federation .

OTHER PUBLICATIONS

M. G. Zabetakis, et al., "Methane Control in United States Coal Mines–1972", U.S. Bureau of Mines, Information Circular 8600, pp. 8–16, (1973).

R. S. Metcalfe, D. Yee, J. P. Seidle, and R. Puri, "Review of Research Efforts in Coalbed Methane Recovery", SPE 23025, (1991).

M. D. Stevenson, W. V. Pinczewski and R. A. Downey, "Economic Evaluation of Nitrogen Injection for Coalseam Gas Recovery", SPE 26199, (1993).

N. Ali, P. K. Singh, C. P. Peng, G. S. Shiralkar, Z. Moschovidis and W. L. Baack, "Injection Above–Parting–Pressure Waterflood Pilot, Valhall Field, Norway", SPE 22893, (1991).

R. Puri and D. Yee, "Enhanced Coalbed Methane Recovery", SPE 20732, (1990).

Brian Evison and R. E. Gilchrist, "New Developments in Nitrogen in the Oil Industry", SPE 24313, (1992).

Alan A. Reznik, Pramod K. Singh and William L. Foley, "An Analysis of the Effect of Carbon Dioxide Injection on the Recovery of In–Situ Methane from Bituminous Coal: An Experimental Simulation", SPE/DOE 10822, (1982).

Ralph W. Veatch, Jr., Zissis A. Mosachovidis and C. Robert Fast, "An Overview of Hydraulic Fracturing", *Recent Advances in Hydraulic Fracturing,* vol. 12, chapter 1, pp. 1–38, S.P.E. Monograph Series, (1989).

(List continued on next page.)

*Primary Examiner*—George A. Suchfield

*Attorney, Agent, or Firm*—Scott P. McDonald; Richard A. Kretchmer

[57] ABSTRACT

Processes are disclosed for separating an oxygen-containing gas into oxygen-enriched and oxygen-depleted streams. The oxygen-depleted stream is injected into a methane-containing solid carbonaceous subterranean formation to produce a methane-containing gaseous mixture. The oxygen-enriched stream is reacted with a stream containing an oxidizable material which can be the methane-containing mixture.

38 Claims, No Drawings

OTHER PUBLICATIONS

Nov. 9, 1990, Report of the Oil and Gas Conservation Commission of the State of Colorado.

N. R. Warpinski and Michael Berry Smith, "Rock Mechanics and Fracture Geometry", *Recent Advances in Hydraulic Fracturing,* vol. 12, chapter 3, pp. 57–80, S.P.E. Monograph Series, (1989).

"Quarterly Review of Methane from CoalSeams Technology", *Gas Research Institute,* vol. 11, No. 1, p. 38, (1993).

Carl L. Schuster, "Detection Within the Wellbore of Seismic Signals Created by Hydraulic Fracturing", SPE 7448, (1978).

Amoco Production Company, Handout distributed at the International Coalbed Methane Symposium held in Birmingham, Alabama, May 17–21, 1993.

Application for Enhanced Recovery Nitrogen Injection Pilot and Approval of Aquifer Exemption, submitted to the Colorado Oil and Gas Conservation Commission, Aug. 30, 1990.

Durango Herald Newspaper Article, "Planners OK Amoco Facilities", dated May 15, 1991.

La Plata County Planning Commission, Colorado Planning Commission Information Session of Mar. 1991 dealing with Amoco's Planned Nitrogen Injection Pilot.

United States Environmental Protection Agency Region VIII, Transmittal Letter of Feb. 11, 1992 approving Nitrogen Injection Pilot and Associated Permits.

METHOD FOR PRODUCING METHANE-CONTAINING GASEOUS MIXTURES

FIELD OF THE INVENTION

This invention generally relates to a method for producing methane-containing gaseous mixtures from solid carbonaceous subterranean formations. The invention more particularly relates to methods for separating an oxygen-containing gas such as air into an oxygen-depleted stream and an oxygen-enriched stream, utilizing the oxygen-depleted stream to produce a methane-containing gas from the formation, and reacting the oxygen-enriched gas with an oxidizable reactant such as methane or a methane-derived reactant as defined herein.

BACKGROUND OF THE INVENTION

Methane is produced by the thermal and biogenic processes responsible for converting organic matter to various solid carbonaceous subterranean materials such as coals and shales. The mutual attraction between the carbonaceous solid and the methane molecules frequently causes a large amount of methane to remain trapped in the solids along with water and lesser amounts of other gases which can include nitrogen, carbon dioxide, various light hydrocarbons, argon and oxygen. When the trapping solid is coal, the methane-containing gaseous mixture that can be obtained from the coal typically contains at least about 95 volume percent methane and is known as "coalbed methane." The world-wide reserves of coalbed methane are huge.

Coalbed methane has become a significant source of the methane distributed in natural gas. Typically, coalbed methane is recovered by drilling a wellbore into a subterranean coalbed having one or more methane-containing coal seams that form a coalbed. The pressure difference between the ambient coalbed pressure (the "reservoir pressure") and the wellbore provides a driving force for flowing coalbed methane into the wellbore. As the ambient coalbed pressure decreases, methane is desorbed from the coal. Unfortunately, this pressure reduction also reduces the driving force necessary to flow methane into the wellbore. Consequently, pressure depletion of coalbeds becomes less effective with time, and is generally believed capable of recovering only about 35 to 50% of the methane contained therein.

An improved method for producing coalbed methane is disclosed in U.S. Pat. No. 5,014,785 to Puri, et al. In this process, a methane-desorbing gas such as an inert gas is injected through an injection well into a solid carbonaceous subterranean formation such as a coalbed. At the same time, a methane-containing gas is recovered from a production well. The desorbing gas, preferably nitrogen, mitigates bed pressure depletion and is believed to desorb methane from the coalbed by decreasing the methane partial pressure within the bed. Recent tests confirm that this process yields increased coalbed methane production rates and suggest that the total amount of recoverable methane may be as high as 80% or more.

Puri et al. also disclose in the above-mentioned U.S. Pat. No. 5,014,785 that air can be injected into a solid carbonaceous subterranean formation to increase methane production. However, injecting an oxygen-containing gas such as air into a coalbed can present several operational problems. For example, the presence of oxygen can cause or increase corrosion-related problems in process equipment such as pumps, compressors and well casings. Also, feeding oxygen-containing fluids into an injection well may form explosive or flammable gas mixtures in the injection well that would not be formed if a gas such as nitrogen was injected into the well. These potential problems may be minimized by reducing the oxygen content of air before injecting air into a formation such as coalbed. One such example of operation with a reduced oxygen content stream is disclosed in Puri, et al., U.S. Pat. No. 5,133,406. The '406 patent discloses depleting the oxygen content of air before injecting the air into a coal seam by inputting air and a source of fuel, such as produced methane, into a fuel cell power system, generating electricity, and forming a fuel cell exhaust comprising oxygen-depleted air.

Co-filed U.S. Ser. No. 08/147,111, which is hereby incorporated by reference, discloses increasing production of methane from solid carbonaceous subterranean formations, such as coalbeds, by processing a gas containing oxygen in a membrane separator, withdrawing oxygen-depleted effluent from the separator, and injecting oxygen-depleted effluent into the solid carbonaceous subterranean formation.

Co-filed U.S. Ser. No. 08/147,125, which is hereby incorporated by reference, discloses increasing the production of methane from solid carbonaceous subterranean formations, such as coal seams, by using a pressure swing process to produce an oxygen-depleted gas.

While the foregoing processes provide improved methods for recovering a methane-containing process stream from solid carbonaceous subterranean formations, the production of the required oxygen-depleted stream is expensive and may in some cases render the economics of the process unfavorable.

In some cases, the foregoing processes may also be economically unfavorable because gaseous components of the injected gas such as nitrogen must be separated from the recovered methane before the methane can be transported through a natural gas pipeline or otherwise utilized.

What is needed is an improved process for the recovery of methane from solid carbonaceous subterranean formations that minimizes the economic impact of the production of oxygen-depleted injectants. Preferably, the process should also mitigate the need to remove injected oxygen-depleted gas from the methane-containing mixture removed from the formation.

SUMMARY OF THE INVENTION

A first aspect of the invention is directed to a process for producing a methane-containing gas and for using a process-derived oxygen-enriched gas stream comprising the steps of physically separating a gaseous mixture containing at least about 10 volume percent oxygen into an oxygen-depleted stream and an oxygen-enriched stream; injecting the oxygen-depleted stream through an injection well in fluid communication with a solid carbonaceous subterranean formation into the formation; recovering a gaseous composition comprising methane from a production well in fluid communication with the solid carbonaceous subterranean formation; and reacting at least a portion of the oxygen-enriched stream with a reactant stream containing at least one oxidizable reactant.

The term "solid carbonaceous subterranean formation" as used herein refers to any substantially solid, methane-containing material located below the surface of the earth produced by the thermal and biogenic degradation of organic matter. Solid carbonaceous subterranean formations include but are not limited coals and shales.

The term "reacted" as used herein refers to any reaction of an oxygen-enriched stream with a second process stream. Examples of such reactions include but are not limited to combustion, as well as other chemical reactions including reforming processes such as the steam reforming of methane to synthesis gas, oxidative chemical processes such as the conversion of ethylene to ethylene oxide, and oxidative coupling processes as described herein.

The term "oxidizable reactant" as used herein means any organic or inorganic reactant that can undergo chemical reaction with oxygen. For example, oxidizable reactants include materials which can be chemically combined with oxygen, that can be dehydrogenated by the action of oxygen, or that otherwise contain an element whose valence state is increased in a positive direction by interaction with oxygen.

The term "organic reactant" as used herein means any carbon- and hydrogen-containing compound regardless of the presence of heteroatoms such as nitrogen, oxygen and sulfur. Examples include but are not limited to methane and other hydrocarbons whether used as combustion fuels or starting materials for conversion to other organic products.

The term "inorganic reactant" as used herein means any reactant which does not contain both carbon and hydrogen.

In a second aspect of the invention, a process for producing a methane-containing gas and for using a process-derived oxygen-enriched gas stream is disclosed which includes the steps of physically separating gas containing at least 10 volume percent oxygen and at least 60 volume percent nitrogen into an oxygen-depleted stream and an oxygen-enriched stream; injecting the oxygen-depleted stream into a solid carbonaceous subterranean formation through an injection well; recovering a gaseous composition comprising methane and nitrogen from a production well in fluid communication with the solid subterranean carbonaceous formation; and reacting at least a portion of the oxygen-enriched stream with a reactant stream containing at least one reactant selected from the group consisting of methane and methane-derived reactants.

As used herein, a "methane-derived reactant" means a compound created directly from a methane-containing feedstock, a compound whose synthesis employs an intermediate compound created from a methane-containing process stream, or a non-inert contaminating compound coproduced with natural gas. Examples of methane-derived reactants include but are not limited to synthesis gas obtained by reforming methane, methanol or dimethyl ether when formed by the direct or stepwise reaction of synthesis gas over a catalyst, mixtures containing $C_2$ and greater hydrocarbons and/or heteroatom-containing variants thereof obtained from a process such as a Fischer-Tropsch catalytic hydrogenation of methane-derived synthesis gas over a catalyst, and the common natural gas contaminant hydrogen sulfide.

In a third aspect of the invention, the invention is directed to a process for producing a methane-containing gas and for using a process-derived oxygen-enriched gas stream comprising the steps of physically separating air into an oxygen-depleted stream comprising a volume ratio of nitrogen to oxygen of at least 9:1 and an oxygen-enriched stream comprising a volume ratio of nitrogen to oxygen of less than 2.5:1; injecting the oxygen-depleted stream into a coalbed through an injection well; recovering a gaseous composition comprising methane and nitrogen from a production well in fluid communication with the coalbed; and reacting at least a portion of the oxygen-enriched stream with a reactant stream containing at least one reactant selected from the group consisting of methane and methane-derived reactants.

As used herein, the term "coalbed" means a single coal seam or a plurality of coal seams which contain methane and through which an injected gas can be propagated to a production well.

As used herein the term "air" refers to any gaseous mixture containing at least 15 volume percent oxygen and at least 60 volume percent nitrogen. Preferably, "air" is the atmospheric mixture of gases found at the well site and contains between about 18 and 20 volume percent oxygen and 80 and 82 volume percent nitrogen.

As used herein, the term "recovering" means a controlled collection and/or disposition of a gas, such as storing the gas in a tank or distributing the gas through a pipeline. "Recovering" specifically excludes venting the gas into the atmosphere.

In yet another aspect of the invention, a process for producing a methane combustion fuel or petrochemical feedstock is disclosed which includes the steps of injecting air into an adsorptive bed of material to establish a total pressure on an adsorptive bed of material, the adsorptive bed of material preferentially adsorbing oxygen over nitrogen; removing a high pressure effluent comprising an oxygen-depleted gaseous effluent having a volume ratio of nitrogen to oxygen of at least 6:1 from the adsorptive bed of material; lowering the total pressure; recovering a low pressure effluent comprising an oxygen-enriched gaseous effluent having a volume ratio of nitrogen to oxygen of less than 4:1; injecting the oxygen-depleted effluent into a solid carbonaceous subterranean formation through an injection well; producing a gaseous composition comprising methane from a production well in fluid communication with the solid carbonaceous subterranean formation; and reacting at least a portion of the oxygen-enriched effluent with the gaseous composition.

Each of the foregoing aspects of the invention provides for an advantageous methane-producing technology because each efficiently exploits the oxygen-enriched by-product stream produced in the production of the oxygen-depleted stream. Exploiting the oxygen-enriched stream in this manner results in more favorable process economics than might otherwise be obtained.

In several preferred embodiments of the invention, a nitrogen-containing methane mixture produced from the subterranean formation is mixed with the oxygen-enriched stream to form a mixture stoichiometrically favorable to combustion, thereby eliminating or reducing the need to remove nitrogen from the produced methane mixture. Other preferred embodiments of the invention utilize methane or methane-derived reactants in various chemical processes. These embodiments are particularly favored because of the availability of methane at or near the production site. In some particularly favorable embodiments, the reacted methane or methane-derived reactant is obtained from the same formation into which the oxygen-depleted gas was injected.

DETAILED DESCRIPTION OF THE INVENTION

The following detailed description describes several processes in accordance with the present invention.

The detailed descriptions provided below are meant to be illustrative only, and are not meant to limit the scope of the invention beyond that recited in the appended claims.

Common to each process described herein is 1) the generation of an oxygen-depleted stream used to enhance the recovery of methane from a subterranean formation and 2) the utilization of an oxygen-enriched stream produced as a byproduct of generating the oxygen-depleted stream in some type of oxidative process. The methane-containing gas produced by practicing this invention can be used for on-site purposes such as fueling power plants, providing feedstock to chemical plants, or operating blast furnaces. Alternatively, the produced gas can be transferred to a natural gas pipeline either with or without pretreatment to remove nitrogen and/or other gases from the produced gas.

While it frequently will be preferred to react a nitrogen and methane-containing gas produced from the subterranean formation with the oxygen-enriched stream generated in the methane recovery process, the oxygen-enriched stream can be reacted with streams containing any oxidizable material without departing from the spirit of the invention. Typically, these streams will contain methane or a compound derived from methane, but other organic materials may be reacted with the oxygen-enriched stream, particularly where an integrated petrochemical complex is located at or near the natural gas production site.

The oxygen-depleted and oxygen-enriched process streams required for practicing the invention can be produced by any technique suitable for physically separating atmospheric air or a similar gas into oxygen-enriched and oxygen-deficient fractions. While many techniques for producing these process streams are known in the art, three suitable separation techniques are membrane separation, pressure swing adsorption and cryogenic separation.

The gas to be fractionated typically will be atmospheric air or a similar gas mixture, although other gaseous mixtures of oxygen and less reactive, preferably inert gases may be used if available. Such other mixtures may be produced by using or mixing gases obtained from processes such as the cryogenic upgrading of nitrogen-containing low BTU natural gas. The following discussion describes atmospheric air as the gas to be fractionated, but is not intended to limit the gas to be fractionated to atmospheric air.

If membrane separation techniques are employed, air should be introduced into the membrane separator under pressure, preferably at a rate sufficient to produce an oxygen-depleted gaseous effluent stream having a nitrogen to oxygen volume ratio of at least 9:1 and an oxygen-enriched effluent stream having a nitrogen to oxygen volume ratio of less than 2.5 to 1.

Any membrane separator unit capable of separating oxygen from nitrogen can be used in the invention. A suitable membrane separator is the "NIJECT" unit available from Niject Services Co. of Tulsa, Okla. Another suitable unit is the "GENERON" unit available from Generon Systems of Houston, Tex.

Membrane separators such as the "NIJECT" and "GENERON" units typically include a compressor section for compressing air and a membrane section for fractionating the air. The membrane sections of both the "NIJECT" and "GENERON" separation units employ hollow fiber membrane bundles. The membrane bundles are selected to be relatively more permeable to a gas or gases required in a first gas fraction such as oxygen, and relatively impermeable to a gas or gases required in a second gas fraction such as nitrogen, carbon dioxide and water vapor. Inlet air is compressed to a suitable pressure and passed through the fibers or over the outside of the fibers.

In an "NIJECT" separator, compressed air on the outside of the hollow fibers provides the driving energy for having oxygen, carbon dioxide and water permeate into the hollow fibers while oxygen-depleted nitrogen passes outside of the fibers. The oxygen-depleted air leaves the unit at about the inlet pressure of 50 psi or higher, generally at least 100 psi.

In a "GENERON" separator, the compressed air passes through the inside of the hollow fibers. This provides the energy to drive the oxygen-enriched air through the fiber walls. The oxygen-depleted air inside the fibers leaves the separator at an elevated pressure of 50 psi or higher, generally at least 100 psi.

Because the oxygen-depleted stream must be injected into formations which typically have an ambient reservoir pressure between about 500 and 2000 psi, it is preferred to use membrane separators which discharge the oxygen-deficient air at an elevated pressure as this reduces subsequent compression costs.

Membrane separators like those just discussed typically operate at inlet pressures of about 50 to 250 psi, and preferably about 100 to 200 psi, at a rate sufficient to reduce the oxygen content of the oxygen-deficient gaseous effluent to a volume ratio of nitrogen to oxygen of about 9:1 to 99:1. Under typical separator operating conditions, higher pressures applied to the membrane system increase gas velocity and cause the gas to pass through the system more quickly, thereby reducing the separating effectiveness of the membrane. Conversely, lower air pressures and velocities provide for a more oxygen-depleted effluent but at a lower rate. It is preferred to operate the membrane separator at a rate sufficient to provide an oxygen-depleted effluent containing about 2 to 8 volume percent oxygen. When atmosphere air containing about 20% oxygen is processed at a rate sufficient to produce an oxygen-deficient fraction containing about 5 volume percent oxygen, the oxygen-enriched air fraction typically contains about 40 volume percent oxygen. Under these conditions, the oxygen-depleted gaseous effluent leaves the membrane separator at a superatmospheric pressure less than about 200 psi.

The oxygen-enriched and oxygen-depleted process streams required by the invention also may be produced by a pressure swing adsorption process. This process typically requires first injecting air under pressure into a bed of adsorbent material which preferentially adsorbs oxygen over nitrogen. The air injection is continued until the desired saturation of the bed of material is achieved. The desired adsorptive saturation of the bed can be determined by routine experimentation.

Once the desired adsorptive saturation of the bed is obtained, the material's adsorptive capacity is regenerated by lowering the total pressure on the bed, thereby causing the desorption of an oxygen-enriched process stream. If desired, the bed can be purged before restarting the adsorption portion of the cycle. Purging the bed in this manner insures that oxygen-enriched residual gas tails will not reduce the bed capacity during the next adsorptive cycle. Preferably, more than one bed of material is utilized so that one adsorptive bed of material is adsorbing while another adsorptive bed of material is being depressurized or purged.

The pressure utilized during the adsorption and desorption portions of the cycle and the differential pressure utilized by the adsorptive separator are selected so as to optimize the separation of nitrogen from oxygen. The differential pressure utilized by the adsorption separator is the difference between the pressure utilized during the adsorption portion of the cycle and the pressure utilized during the desorption portion of the cycle. The cost of pressurizing the injected air is important to consider when determining what pressures to use.

The flow rate of the oxygen-depleted stream removed during the adsorption portion of the cycle must be high enough to provide an adequate flow but low enough to allow for adequate separation of the components of the air. Typically, the rate of air injection is adjusted so that, in conjunction with the previous parameters, the recovered oxygen-depleted gaseous effluent stream has a nitrogen to oxygen volume ratio of about 9:1 to 99:1.

Generally, the higher the inlet pressure utilized, the more gas that can be adsorbed by the bed. Also, the faster the removal of oxygen-depleted gaseous effluent from the system, the higher the oxygen content of the gaseous effluent. In general, it is preferred to operate the pressure swing adsorption separator at a rate sufficient to provide oxygen-depleted air containing about 2 to 8 volume percent oxygen. In this way, it is possible to maximize production of oxygen-depleted air and at the same time obtain the advantages implicit in injecting oxygen-depleted air into the formation.

A wide variety of adsorbent materials are suitable for use in a pressure swing adsorption separator. Adsorbent materials which are particularly useful include carbonaceous materials, alumina-based materials, silica-based materials, and zeolitic materials. Each of these material classes includes numerous material variants characterized by material composition, method of activation, and the selectivity of adsorption. Specific examples of materials which can be utilized are zeolites having sodium aluminosilicate compositions such as "4A"-type zeolite and "RS-10" (a zeolite molecular sieve manufactured by Union Carbide Corporation), carbon molecular sieves, and various forms of activated carbon.

A third method for fractionating air into oxygen and nitrogen is cryogenic separation. In this process, air is first liquified and then distilled into an oxygen fraction and a nitrogen fraction. While cryogenic separation routinely produces nitrogen fractions having less than 0.01% oxygen contained therein and oxygen fractions containing 70% or more oxygen, the process is extremely energy intensive and therefore expensive. Because the presence of a few volume percent oxygen in a nitrogen is not believed to be detrimental when such a stream is used for methane recovery, the relatively pure nitrogen fraction typically produced by cryogenic separation will not ordinarily be cost justifiable.

The oxygen-deficient process stream must be injected into the solid carbonaceous subterranean formation at a pressure higher than the reservoir pressure and preferably lower than the fracture pressure of the formation. If the pressure is too low the gas cannot be injected. If the pressure is too high and the formation fractures, the gas may be lost through the fractures. In view of these considerations and the pressure encountered in typical formations, the oxygen-depleted gas stream will usually be pressurized to about 400 to 2000 psi in a compressor before injecting the stream into the formation through one or more injection wells terminating in or in fluid communication with the formation.

While any compressor can be used to compress the oxygen-depleted stream, it will sometimes be advantageous to use a methane-fueled compressor due to the availability of methane at the production site. If desired, such a compressor may be run on methane-containing gas produced from the subterranean formation and the oxygen-enriched by-product stream as described in detail below.

A gaseous methane-containing mixture is recovered from the solid carbonaceous subterranean formation through at least one production well in fluid communication with the formation. Preferably, the production well terminates in one or more methane-containing seams such as coal seams located within a coalbed. While intraseam termination is preferred, the production well need not terminate in the seam as long as fluid communication exists between the methane-containing portion of the formation and the production well. The production well is operated in accordance with conventional coalbed methane recovery wells. It may, in some cases, be preferred to operate the production well at minimum possible backpressure to facilitate the recovery of the methane-containing fluid from the well.

The injection of-the oxygen-depleted stream into the formation may be continuous or discontinuous. Additionally, the injection pressure may be maintained constant or varied. Preferably, the injection pressure should be less than the formation parting pressure.

In some cases, it may be desirable to inject methane-desorbing gases into a formation at a pressure above-the formation parting pressure if fractures are not induced which extend from an injection well to a production well. Injection pressures above the formation parting pressure may cause additional fracturing that increases formation injectability, which in turn can increase methane recovery rates. Preferably, the fracture half-lengths of formation fractures induced by injecting above the formation parting pressure are less than about 20% to about 30% of the spacing between an injection well and a production well. Also, preferably, the induced fractures should not extend out of the formation.

Parameters important to methane recovery such as fracture half-length, azimuth, and height growth can be determined using formation modeling techniques known in the art. Examples of such techniques are discussed in John L. Gidley, et al., Recent Advances in Hydraulic Fracturing, Volume 12, Society of Petroleum Engineers Monograph Series, 1989, pp. 25–29 and pp. 76–77; and Schuster, C. L., "Detection Within the Wellbore of Seismic Signals Created by Hydraulic Fracturing," paper SPE 7448 presented at the 1978 Society of Petroleum Engineers' Annual Technical Conference and Exhibition, Houston, Tex., October 1–3. Alternatively, fracture half-lengths and orientation effects can be assessed using a combination of pressure transient analysis and reservoir flow modeling such as described in paper SPE 22893, "Injection Above Fracture Parting Pressure Pilot, Valhal Field, Norway," by N. Ali et al., 69th Annual Technical Conference and Exhibition of the Society of Petroleum Engineers, Dallas, Texas, October 6–9, 1991. While it should be noted that the above reference describes a method for enhancing oil recovery by injecting water above the formation parting pressure, it is believed that the methods and techniques discussed in SPE 22893 can be adapted to enhance methane recovery from a solid carbonaceous subterranean formation such as a coalbed.

Injection of the oxygen-depleted gas into the formation stimulates or enhances the production of methane from the formation. The timing and magnitude of the increase in the rate of methane recovery from a production well will depend on many factors including, for example, well spacing, seam thickness, cleat porosity, injection pressure and injection rate, injected gas composition, sorbed gas composition, formation pressure, and cumulative production of methane prior to injection of the oxygen-depleted gas.

All other things being equal, a smaller spacing between injection and productions wells typically will result in both an increase in the recovery rate of methane and a shorter time before injected oxygen-depleted gas appears at a production well. When spacing the wells, the desirability of a rapid increase in methane production rate must be balanced against other factors such as earlier nitrogen breakthrough in the recovered gas. If the spacing between the wellbores is too small, the oxygen-depleted gas molecules will pass through the formation to a production well without being efficiently utilized to desorb methane from within the carbonaceous matrix.

Preferably, the methane-containing fluid recovered from the well typically will contain at least 65 percent methane by volume, with a substantial portion of the remaining volume percent being the oxygen-depleted gas stream injected into-the formation. Relative fractions of methane, oxygen, nitrogen and other gases contained in the produced mixture will vary with time due to methane depletion and the varying transit times through the formation for different gases. In the early stages of well operation, one should not be surprised if the recovered gas closely resembles the in situ composition of coalbed methane. After continued operation, significant amounts of the injected oxygen-depleted gas can be expected in the recovered gas.

The oxygen-enriched gas stream resulting from the production of the oxygen-depleted injection fluid can be utilized in a variety of ways. For example, the oxygen-enriched stream can be reacted with a stream containing one or more organic compounds. The reaction can be combustion or another type of chemical reaction. In most cases, reacted organic compounds will be methane or derived from a methane feedstock, although the oxygen-enriched feedstock can be used advantageously in other chemical or combustion processes, particularly if an integrated chemical or industrial complex is located at or near the production well.

Use of an oxygen-enriched stream containing 25 volume per unit or more oxygen in conjunction with other process streams containing organic compounds will often require optimization of the concentrations of the oxygen, nitrogen and other gases contained in the process streams. For example, if blends of oxygen-enriched air are reacted with methane-containing nitrogen or nitrogen and carbon dioxide, it frequently will be desirable to control the volume of the oxygen-enriched stream combined with the methane in order to control the ratio of methane to oxygen in the resulting mixture. This will permit an optimized combustion if the mixture is burned. Alternatively, if the mixture is used as a feedstock for a petrochemical process such as synthesis gas formation as discussed below, the methane to oxygen ratio will be optimized for that purpose. Control over the amount of oxygen-enriched air which is used can be particularly important because the concentration of gases such as carbon dioxide and nitrogen in the methane may not be constant with time.

The invention is particularly well-suited to processes requiring the on-site generation of power or heat. For example, calculations show that a representative mixture withdrawn from a production well in accordance with the present invention containing 16 weight percent nitrogen and 84 weight percent methane may be burned with a 40 volume percent oxygen-enriched process-derived stream to yield the same quantity of heat as the combustion of air and pure methane. Combining the production well's methane/nitrogen stream with the process oxygen-rich stream in this manner reduces costs by eliminating the need to remove nitrogen from the produced natural gas stream before combustion. The heat produced can be used for a variety of purposes by employing heat exchange means which are well-known in the art.

Combustion of a nitrogen/methane stream with the oxygen-enriched stream is particularly well-suited to the on-site production of electricity. This is especially true in countries or regions which have a fairly well-developed electrical distribution system but do not have a pipeline system for the transportation of natural gas. In a case such as this, the produced nitrogen/methane stream can be burned with the oxygen-enriched stream in natural gas-fired electrical generation equipment such as a turbine-driven generator. Such a plant is capable of consuming large quantities of the identified gas streams and converting the resulting energy to an easily distributed form, thereby avoiding the need to remove nitrogen from the produced gas and as well as eliminating the need for a pipeline system.

The oxygen-enriched process stream also can be used advantageously in a wide variety of non-combustive chemical reactions. The stream is most advantageously used in conjunction with methane-requiring processes located near the production well. One oxygen-utilizing process particularly well suited to the invention is the oxidative coupling of methane to higher molecular weight hydrocarbons useful as chemical reactants or fuels such as gasoline.

A typical oxidative coupling process reacts an oxygen-containing gas such as air with methane vapors over an oxidative coupling "contact" material or catalyst to "couple" together methane molecules and previously "coupled" hydrocarbons to form higher molecular weight hydrocarbons. A wide variety of contact materials useful for oxidative coupling reactions are well-known in the art and typically comprise a mixture of various metals often including rare earths in a solid form known to be stable under the oxidative coupling reaction conditions. One representative contact material is disclosed in U.S. Pat. No. 5,053,578, the disclosure of which is hereby incorporated by reference. This material contains a Group IA metal, a Group IIB metal and a metal selected from the group consisting of aluminium, silicon, titanium, zinc, zirconium, cadmium and tin.

The oxidative coupling reaction can be carried out under a wide variety of operating conditions. Representative conditions for the reaction include gas hourly space velocities between 100 and 20,000 $hrs^{-1}$, methane to oxygen ratios of about 2:1 to 10:1, pressures ranging from subambient to 10 atmospheres or more, and temperatures ranging from about 400° C. to about 1,000° C. It should be noted that temperatures above about 1,000° C. are not preferred as thermal reactions begin to overwhelm the oxidative coupling reaction at these temperatures.

The nitrogen-containing methane feedstock produced from the coalbed may be used "as is" as a source of methane because the presence of additional nitrogen is not believed to seriously effect the oxidative coupling reaction. Additionally, the oxygen-rich stream may be advantageously used to provide a source of oxygen for the oxidative coupling reaction. Such a process is economically favorable when compared to a typical methane/air oxidative coupling process because the increased oxygen content of the oxygen-enriched stream reduces the bulk gas volume required to be handled in the process. Reducing the volume lowers the energy and compressor costs from those required for oxidative coupling processes employing air as a source of oxygen when pressures above about two atmospheres are employed as less nitrogen needs to be compressed and transported through the process. Of course, where a methane and nitrogen mixture is used as an oxidative coupling feedstock at these relatively higher pressures, compressors and related physical plant requirements need to be sized to accommodate the additional gas volume attributable to the nitrogen contained in the feedstock.

The oxygen-enriched stream created in the inventive process also can be used in a variety of other chemical and petrochemical processes requiring a source of oxygen. In these cases, use of the oxygen-enriched stream reduces or eliminates capital costs that would otherwise be required for an oxygen production plant. This in turn can render many economically unfavorable chemical processes economically favorable.

Examples of processes that can benefit from the availability of an oxygen-rich stream in accordance with the present invention include:

(1) steel-making operations in which oxygen is used both to promote fuel efficiency and remove contaminants such as carbon and sulfur by oxidizing these contaminants typically present in liquified iron;

(2) non-ferrous metals production applications where an oxygen-enriched gas is used to save time and money in the reverberatory smelting of metals such as copper, lead, antimony and zinc; and (3) chemical oxidation processes such as the catalytic oxidation of ethylene to ethylene oxide or ethylene glycol or the production of acetic acid, as well as the liquid phase oxidation or oxychlorination of any suitable organic feed compound.

The invention also is well-suited to the production of synthesis gas, which can be converted to chemicals such as methanol, acetic acid or dimethyl ether by conventional and well-known chemical processes. In these applications, synthesis gas can be produced by reacting the oxygen-enriched stream with a methane-containing stream by any of several well-known processes such as steam reforming. The synthesis gas stream then may be used to form organic compounds which contain 2 or more carbon atoms in a process such as the Fischer-Tropsch process wherein synthesis gas is catalytically converted over any of a number of well-known catalysts to produce a wide variety of mixtures of $C_2$ to C10 organic compounds such as hydrocarbons and alcohols.

Yet another use for an oxygen-enriched stream generated in accordance with the present invention is to improve the capacity of hydrogen sulfide-removing processes such as those employed in-the Claus process. As is known in the art, natural gas can contain appreciable quantities of hydrogen sulfide, or $H_2S$, gas. The highly corrosive gas must be removed from natural gas prior to distribution of the natural gas, and is typically removed from natural gas by scrubbing with a solution of an amine in water, such as by scrubbing with monoethanol or diethanol amine in a packed column or tray tower. The $H_2S$ typically then is converted to elemental sulfur through a process known as the Claus process.

In the Claus process, $H_2S$ gas is converted to elemental sulfur in accordance with the following equations:

$$H_2S+3/2\ O_2 \rightarrow SO_2+H_2O \quad \text{(I)}$$

$$2H_2S+SO_2 \rightarrow 3S+2H_2O \quad \text{(II)}$$

$$3H_2S+3/2\ O_2 \rightarrow 3S+3H_2O \text{ (Net Reaction )} \quad \text{(III)}$$

As can be seen from Equation (I), the oxygen-enriched stream of the present invention can be advantageously used to promote the oxidation of hydrogen sulfide gas.

It is believed that applying an oxygen-enriched stream having up to about 30 weight percent oxygen in accordance with the present invention to an existing Claus plant can increase the capacity of the plant up to about 25 percent without substantial plant modification. Additional capacity could be gained by specifically designing a Claus reactor to employ an oxygen-enriched stream which contains more than about 30 weight percent oxygen. Using the oxygen-enriched stream of this invention in this manner provides an opportunity for substantial capital cost savings where an oxygen-enriched stream is available.

The foregoing descriptions provide several examples of the subject invention wherein methane production from a solid carbonaceous subterranean formation is enhanced, while at the same time the economics of an oxygen-requiring process are improved.

It should be appreciated that various other embodiments of the invention will be apparent to those skilled in the art through modification or substitution without departing from the spirit and scope of the invention as defined in the following claims.

We claim:

1. A process for producing a methane-containing gas and for using a process-derived oxygen-enriched gas stream comprising the steps of:

physically separating a gaseous mixture containing at least about 10 volume percent oxygen into an oxygen-depleted stream and an oxygen-enriched stream;

injecting the oxygen-depleted stream through an injection well in fluid communication with a solid carbonaceous subterranean formation;

recovering a gaseous composition comprising methane from a production well in fluid communication with the solid carbonaceous subterranean formation; and reacting at least a portion of the oxygen-enriched stream with a reactant stream containing at least one oxidizable reactant.

2. The process of claim 1 wherein the oxidizable reactant is selected from the group consisting of methane and methane-derived reactants.

3. The process of claim 2 wherein the oxidizable reactant is obtained from methane produced from the solid carbonaceous subterranean formation.

4. A process for producing a methane-containing gas and for using a process-derived oxygen-enriched gas stream comprising the steps of:

physically separating a gas containing at least 10 volume percent oxygen and at least 60 volume percent nitrogen into an oxygen-depleted stream and an oxygen-enriched stream;

injecting the oxygen-depleted stream into a solid carbonaceous subterranean formation through an injection well;

recovering a gaseous composition comprising methane and nitrogen from a production well in fluid communication with the solid subterranean carbonaceous formation; and reacting at least a portion of the oxygen-enriched stream with a reactant stream containing at least one reactant selected from the group consisting of methane and methane-derived reactants, said reactant being derived from the recovered gaseous composition.

5. The process of claim 4 wherein the reactant is obtained from methane produced from the solid carbonaceous subterranean formation.

6. The process of claim 4, wherein the oxygen-depleted stream comprises a volume ratio of nitrogen to oxygen ratio of at least 9:1.

7. The process of claim 4 wherein the oxygen-enriched stream comprises a volume ratio of nitrogen to oxygen of less than 2.5 to 1.

8. The process of claim 4 wherein the gaseous composition produced from the solid subterranean carbonaceous formation comprises at least 65 volume percent methane.

9. The process of claim 8 wherein the oxygen-enriched stream comprises at least 25 volume percent oxygen and wherein the oxygen-enriched stream is reacted with at least a portion of the gaseous composition recovered from the production well.

10. The process of claim 9 wherein the recovered gaseous composition and the oxygen-enriched stream are reacted by combustion.

11. The process of claim 4 wherein the oxygen-enriched stream is used in a process selected from the group consisting of the production of synthesis gas from methane, the oxidative coupling of methane to higher molecular weight hydrocarbons, and the Claus reaction oxidation of a hydrogen sulfide gas stream.

12. A process for producing a methane-containing gas and for using a process-derived oxygen-enriched gas stream comprising the steps of:

physically separating air into an oxygen-depleted stream comprising a volume ratio of nitrogen to oxygen of at least 9:1 and an oxygen-enriched stream comprising a volume ratio of nitrogen to oxygen of less than 2.5 to 1;

injecting the oxygen-depleted stream into a coalbed through an injection well;

recovering a gaseous composition comprising methane from a production well in fluid communication with the coalbed; and reacting at least a portion of the oxygen-enriched stream with a reactant stream containing at least one oxidizable reactant and a portion of the recovered stream containing nitrogen.

13. The process of claim 12 wherein the oxidizable reactant is selected from the group consisting of methane and methane-derived reactants.

14. The process of claim 13, wherein the recovered gaseous composition comprises at least 65 volume percent methane.

15. The process of claim 13 wherein the reactant stream comprises methane.

16. The process of claim 15 wherein-the methane comprising the reactant stream is recovered from the coalbed.

17. The process of claim 16 wherein the the reactant stream and the oxygen-enriched stream are reacted by combustion.

18. The process of claim 13 wherein the oxygen-enriched stream is used in a process selected from the group consisting of the production of synthesis gas from methane, the oxidative coupling of methane to higher molecular weight hydrocarbons, and the Claus reaction oxidation of a hydrogen sulfide stream removed from natural gas.

19. The process of claim 15 wherein the methane reactant stream and the oxygen-enriched stream are reacted in an oxidative coupling reaction.

20. The method of claim 17 wherein the reactant stream and the oxygen-enriched stream are combusted to provide energy for an electrical generating plant.

21. A process of producing a methane combustion fuel or petrochemical feed stock comprising the steps of:

injecting air into an adsorptive bed of material to establish a total pressure on the adsorptive bed of material, the adsorptive bed of material preferentially adsorbing oxygen over nitrogen;

removing a high pressure effluent, comprising an oxygen-depleted gaseous effluent having a volume ratio of nitrogen to oxygen of at least 6:1, from the adsorptive bed of material;

lowering the total pressure;

recovering a low pressure effluent comprising an oxygen-enriched gaseous effluent having a volume ratio of nitrogen to oxygen of less than 4:1;

injecting the oxygen-depleted effluent into a solid subterranean carbonaceous formation through an injection well;

recovering a gaseous composition comprising injected nitrogen and methane from at least one production well; and reacting the oxygen-enriched effluent with the gaseous composition.

22. The process of claim 21 wherein the gaseous composition comprises at least 65 volume percent methane.

23. The process of claim 21 wherein the solid subterranean carbonaceous formation is a coalbed.

24. The process of claim 22 wherein the gaseous composition is reacted by combustion with-the oxygen-enriched stream 25. The process of claim 21 wherein the oxygen-enriched effluent and methane from the gaseous composition are reacted in an oxidative coupling reaction.

26. The process of claim 21 wherein the oxygen-enriched effluent and methane from the gaseous composition are reacted to produce synthesis gas.

27. The process of claim 21 wherein the high pressure effluent has a nitrogen to oxygen ratio of at least 9:1 and wherein the oxygen-enriched gaseous effluent has a nitrogen to oxygen volume ratio of less than 2.5:1.

28. A process of producing a synthesis gas comprising the steps of:

injecting air into an adsorptive bed of material to establish a total pressure on the adsorptive bed of material, the adsorptive bed of material preferentially adsorbing oxygen over nitrogen;

removing a high pressure effluent, comprising an oxygen-depleted gaseous effluent having a volume ratio of nitrogen to oxygen of at least 6:1, from the adsorptive bed of material;

lowering the total pressure;

recovering a low pressure effluent comprising an oxygen-enriched gaseous effluent having a volume ratio of nitrogen to oxygen of less than 4:1;

injecting the oxygen-depleted effluent into a solid subterranean carbonaceous formation through an injection well;

recovering a gaseous composition comprising methane from at least one production well; and reacting the oxygen-enriched effluent with the gaseous composition to produce synthesis gas.

29. The process of claim 28 wherein the gaseous composition comprises at least 65 volume percent methane.

30. The process of claim 28 wherein the solid subterranean carbonaceous formation is a coalbed.

31. The process of claim 28 wherein the high pressure effluent has a nitrogen to oxygen ratio of at least 9:1 and wherein the oxygen-enriched gaseous effluent has a nitrogen to oxygen volume ratio of less than 2.5:1.

32. A process of producing a methane combustion fuel comprising the steps of:

injecting air into an adsorptive bed of material to establish a total pressure on the adsorptive bed of material, the adsorptive bed of material preferentially adsorbing oxygen over nitrogen;

removing a high pressure effluent, comprising an oxygen-depleted gaseous effluent having a volume ratio of nitrogen to oxygen of at least 6:1, from the adsorptive bed of material;

lowering the total pressure;

recovering a low pressure effluent comprising an oxygen-enriched gaseous effluent having a volume ratio of nitrogen to oxygen of less than 4:1;

injecting the oxygen-depleted effluent into a solid subterranean carbonaceous formation through an injection well;

recovering a gaseous composition comprising methane from at least one production well; and reacting the oxygen-enriched effluent with the gaseous composition by combustion with the oxygen-enriched effluent.

33. The process of claim 32 wherein the gaseous composition comprises at least 65 volume percent methane.

34. The process of claim 32 wherein the solid subterranean carbonaceous formation is a coalbed.

35. The process of claim 32 wherein the high pressure effluent has a nitrogen to oxygen ratio of at least 9:1 and wherein the oxygen-enriched gaseous effluent has a nitrogen to oxygen volume ratio of less than 2.5:1.

36. The process of claim 32 wherein the combustion reaction provides energy for the generation of electrical power.

37. The process of claim 36 wherein the formation comprises a coalbed, wherein the high pressure effluent has a nitrogen to oxygen ratio of at least 9:1 and wherein the oxygen-enriched gaseous effluent has a nitrogen to oxygen volume ratio of less than 2.5:1.

38. The process of claim 36 wherein the combustion reaction provides energy for the generation of electrical power.

* * * * *